United States Patent [19]

Nadin

[11] Patent Number: 4,957,451

[45] Date of Patent: Sep. 18, 1990

[54] MALE ELECTRICAL CONTACT

[75] Inventor: Léonard Nadin, L'Union, France

[73] Assignee: Labinal S.A., Mon Tigny le Bretonneux, France

[21] Appl. No.: 462,225

[22] Filed: Jan. 9, 1990

[30] Foreign Application Priority Data

Jan. 10, 1989 [FR] France ..... 89 00212

[51] Int. Cl.[5] ..... H01R 4/24

[52] U.S. Cl. ..... 439/395; 439/885; 29/874

[58] Field of Search ..... 439/391–407, 439/884, 885, 889, 851–858; 29/874, 884

[56] References Cited

U.S. PATENT DOCUMENTS

| | | | |
|---|---|---|---|
| 4,684,197 | 8/1987 | Reichardt et al. | 439/404 |
| 4,902,243 | 2/1990 | Davis | 439/405 |
| 4,909,954 | 3/1980 | Paradis | 439/405 |

FOREIGN PATENT DOCUMENTS

| | | |
|---|---|---|
| 1615681 | 6/1970 | Fed. Rep. of Germany . |
| 1615864 | 6/1970 | Fed. Rep. of Germany . |
| 2856549 | 7/1979 | Fed. Rep. of Germany . |
| 1176688 | 4/1959 | France . |
| 2030727 | 11/1970 | France . |

*Primary Examiner*—David L. Pirlot

*Attorney, Agent, or Firm*—Sandler, Greenblum & Bernstein

[57] ABSTRACT

A male electrical contact comprises a substantially U-shape body incorporating two side members and a center member. There is a bar at one end and the other end is adapted for connecting the body to an electrical conductor. The contact is manufactured by bending a blank formed from a material that is a good electrical conductor. The material comprises two strips of different thickness. The bar and the adjoining part of the body are formed from the thicker of these strips.

10 Claims, 4 Drawing Sheets

FIG.1
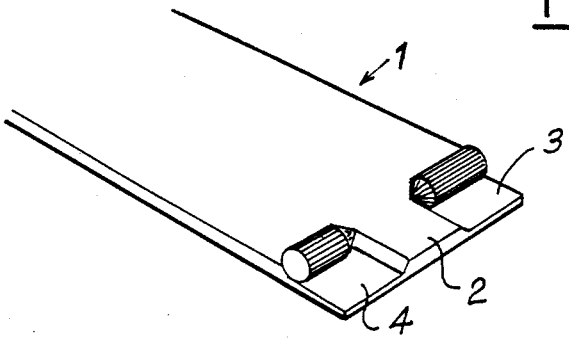
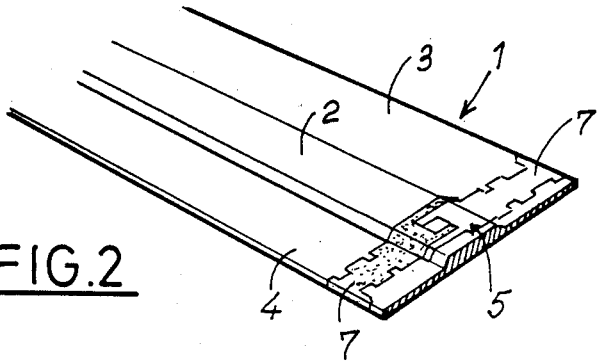
FIG.2
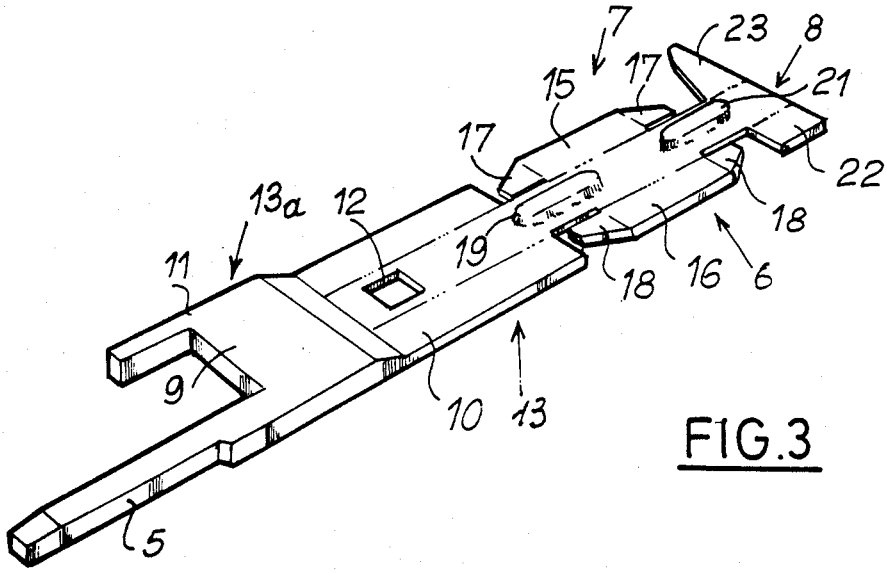
FIG.3

FIG.7
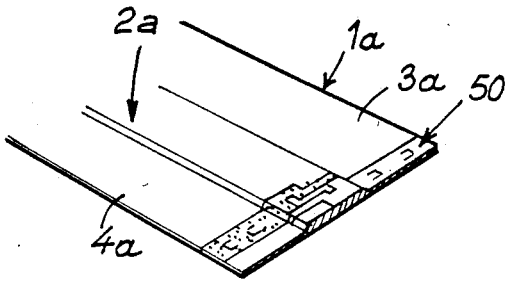
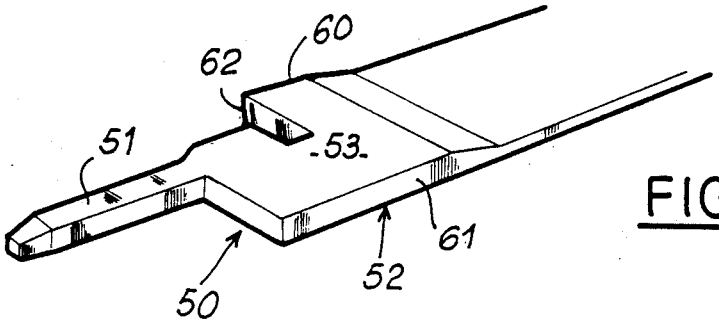
FIG.8
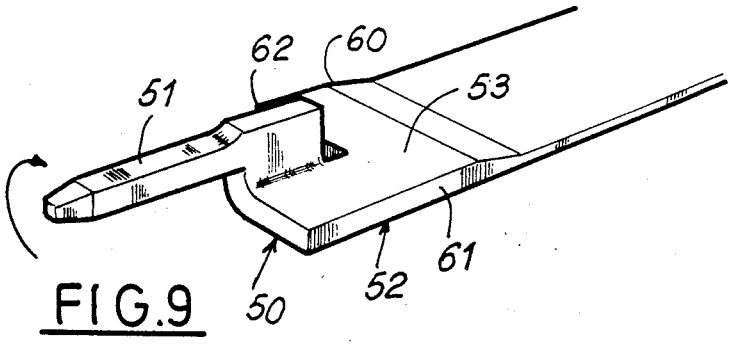
FIG.9
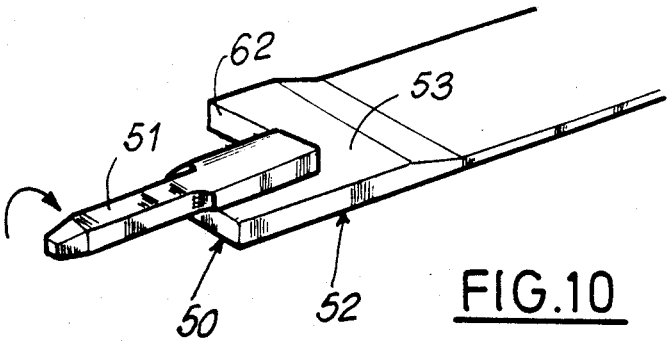
FIG.10

MALE ELECTRICAL CONTACT

BACKGROUND OF THE INVENTION

1. Field of the Invention

The invention is directed to the manufacture of male electrical contacts of the type comprising a substantially U-shape body one end of which is extended to constitute a bar adapted to be inserted into a female electrical contact while the other end comprises means for connecting it to an electrical conductor, these means generally being either crimping lugs or so-called "insulation displacement" connecting means.

2. Description of the Prior Art

For reasons associated with cost and tooling, contacts of this type are manufactured from thin blanks of a metal that is a good electrical conductor appropriately cut and bent. The blanks are cut from stripform metal stock. Various component parts of the contact are bent and then, after the conductor is fitted, some parts must be crimped.

The bar which makes the electrical connection to the corresponding female contact must have some mechanical strength and must be thicker than the rest of the body of the contact. The bar is generally formed by cutting from the metal stock a part wider than the final bar and a U-shape or L-shape part is made by bending appropriate portions into contact with each other.

A method of this kind has many disadvantages.

Given the tolerances, the bar is not always the same thickness. It may also exhibit differences in shape, its portions being applied together more or less well, which compromises the quality of the electrical connection. Also, the part of the U-shape body adjacent the bar is necessarily thinner and this results in a weaker area.

One object of the present invention is to remedy these various disadvantages.

SUMMARY OF THE INVENTION

The present invention consists in a male electrical contact comprising a substantially U-shape body incorporating two side members, a center member, a bar at one end and means at the opposite end for connecting said body to an electrical conductor, wherein said contact is manufactured by bending a blank formed from a material that is a good electrical conductor and that comprises two strips of different thickness and said bar and the adjoining part of said body are formed from the thicker of said strips.

By virtue of this provision the bar inherently has the necessary cross-section and it is certain that the part of the body adjacent to the bar is not weakened.

In one embodiment of the invention the bar forms an extension of one side member of the body and is bent during manufacture towards the other side member and so that it lies in a median plane through the center member.

In one embodiment the body incorporates a slot transverse to the bar and the part of the bar adjacent the slot is bent into contact with the center member.

In one embodiment the material from which the blank is formed has a relatively thick central strip and two relatively thin lateral strips and the blanks are cut out from the material in pairs in a head-to-tail arrangement.

In one embodiment the connecting means are of the insulation displacement type and comprise lugs cutting out from the body, bent during manufacture to extend between the side members of the body and comprising slots in their free edges.

In one embodiment the connecting means are of the insulation displacement type and comprise two branches bent during manufacture to form in conjunction with the center member a U-shape portion, each branch is extended at each end by a lug and the lugs are bent during manufacture so that the lugs on one branch are aligned with the corresponding lugs on the other branch.

In one embodiment the part of the body comprising the connecting means and adjacent the part thereof comprising the bar incorporates a stiffener in the form of a rib.

In one embodiment the branches incorporate stamped stiffeners.

In one embodiment the end of the body opposite that comprising the bar incorporates tangs for crimping an electrical conductor.

In one embodiment the part of the body comprising the crimping tangs and adjacent the part thereof comprising the connecting means incorporates a stiffener in the form of a rib.

The invention will now be described in more detail with reference to specific embodiments given by way of example only and shown in the appended drawings.

BRIEF DESCRIPTION OF THE DRAWINGS

FIG. 1 shows the metal stock used in the manufacture of an electrical contact in accordance with the invention.

FIG. 2 shows the machined metal stock used in the manufacture of an electrical contact in accordance with the invention.

FIG. 3 shows a contact blank in accordance with the invention.

FIG. 7 shows the manufacture of another electrical contact from machined metal stock.

FIG. 8 shows the contact blank made from the FIG. 7 metal stock.

FIGS. 9 and 10 show successive stages in bending the blank from FIG. 8.

DETAILED DESCRIPTION OF THE INVENTION

FIG. 1 is a perspective view of metal stock 1 made from a metal that is a good electrical conductor to be used in the manufacture of male electrical contacts adapted to cooperate with female electrical contacts. The metal stock is preferably plated, for example tinned.

The metal stock 1 is relatively thick and is machined so as to leave a central strip 2 having the original thickness and two lateral strips 3 and 4 that are thinner. The machining may be carried out by milling, for example.

Figure 4:
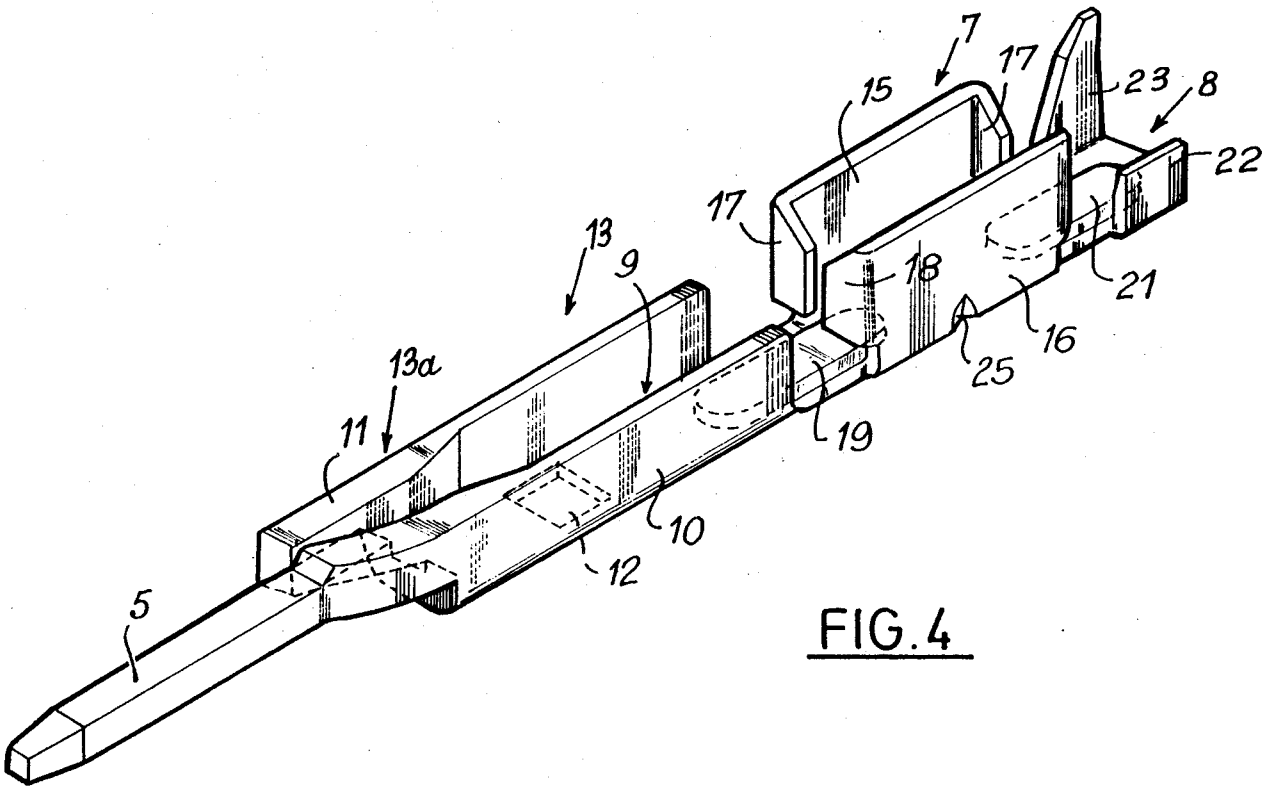
FIG. 4 is a perspective view of the contact made from the flat blank from FIG. 3.

FIGS. 3 and 4 show a male electrical contact 7 comprising three parts 6, 8 and 13. The part 13 terminates at its free end in a bar 5 adapted to be inserted into a corresponding female contact. The part 13 is cut to a shape such that it can be bent into a U-shape with a center member 9 and two side members 10 and 11, the center member 9 comprising a hole 12 for fixing it into a passage in an insulative housing and the side member 10 being extended by the bar 5. The part 6 is cut to a shape which features two branches 15 and 16 with lateral lugs 17 and 18 bent with one facing the other so as to form so-called "insulation displacement" connecting means for connecting a flexible insulated conductor.

Finally, the part 8 comprises two tangs 22 and 23, the tang 22 being adapted to serve as a guide for the electrical conductor and the tang 23 being adapted to constitute a crimping tang for securing said conductor.

The intermediate portion of the male contact between the parts 6 and 13 is stiffened by a rib 19. Similarly, the portion between the parts 6 and 8 is stiffened by a rib 21.

Finally, the branches 15 and 16 comprise stamped areas 25 to prevent them moving apart and to stiffen them on inserting the conductor.

As can be seen in FIGS. 2, 3 and 4 the bar 5 is offset axially and during manufacture of the contact is bent towards the side member 11 and then bent to extend axially. This arrangement enables a significant saving in material when the contacts are cut out from the metal stock 1 (see FIG. 2).

Note that the bar 5 and a portion 13*a* of the part 3 have a cross-section which corresponds to the thickness of the central strip 2 while the rest of the contact has a thickness corresponding to the thickness of the lateral strips 3 and 4.

As the metal stock is already tinned when the blanks are cut out the side surfaces of the bar 5 are no longer plated. Note that when the contact is completed the non-tinned sides are the upper and lower side whereas the other two sides, which are those which cooperate with a corresponding female contact, are still plated. In this way a good electrical contact is assured.

Figure 5:
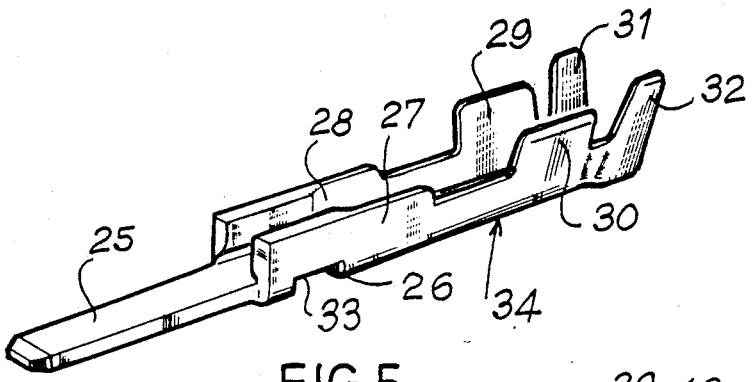
FIG. 5 is a perspective view of another embodiment of the invention.

FIG. 5 shows another embodiment of male electrical contact. This contact features a bar 25 which is made from the strip 2 and which constitutes an extension of the center member 26 of a body 34 incorporating a hole 33, two side members 27 and 28 and crimping tangs 29, 30, 31 and 32. The body 34 is cut out from one of the lateral strips 3 or 4. The part of the center member 26 and the side member 27 and 28 adjacent to the bar 25 is cut out from the strip 2.

Figure 6:
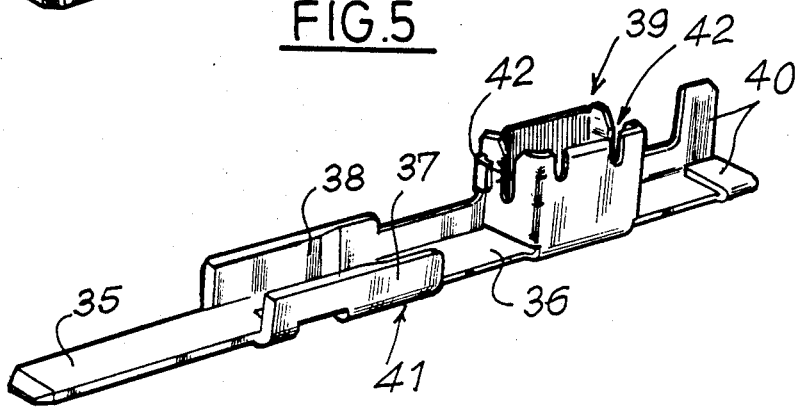
FIG. 6 shows a further embodiment of the invention.
Figure 11:
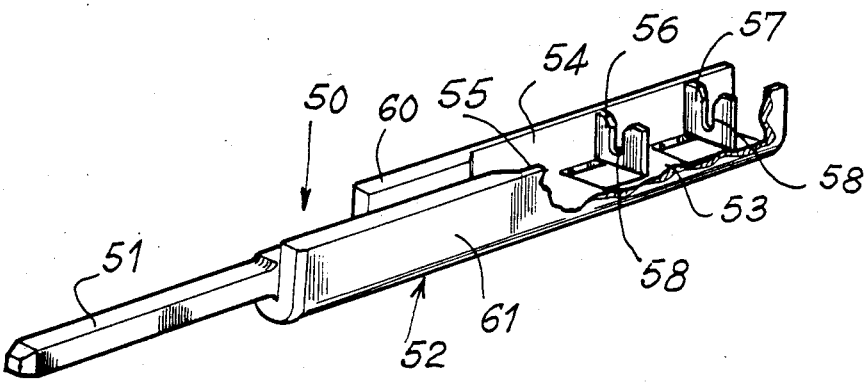
FIG. 11 is a perspective view of the contact made from the blank from FIG. 8.

FIG. 6 shows a further embodiment in which the male electrical contact comprises a body 41 bent to a U-shape having a center member 36 and two side members 37 and 38. The center member 36 is extended at one end by a bar 35 and at the other end by insulation displacement connecting means 39 comprising two slots 42 the width of which is less than the diameter of the core of the insulated conductor to be connected so that its insertion into the slots 42 cuts through the insulation so that the electrical connection is made. Finally, the body 41 ends with two crimping tangs 40 adapted to grip the conductor to secure it.

As in the previous examples, the bar 35 and the part of the center member 36 and the side members 37 and 38 adjacent said bar 35 are cut out from the strip 2 and the body is cut out from one of the strips 3 or 4.

FIGS. 7 through 11 show a further embodiment of the invention in which the male contacts are cut out in pairs in a head-to-tail arrangement of two bodies 50 from metal stock 1*a* comprising a thick central strip 2*a* and two thin marginal strips 3*a* and 4*a*.

Each body 50 comprises a bar 51 and a part 52 adapted to be folded into a U-shape having two side members 60 and 61 and a center member 53. The side members 60 and 61 and the bar 51 are cut out from the strip 2*a* whereas the extensions 54 and 55 of said side members are cut out from the marginal strip 3*a* or 4*a*. The center member 53 comprises a thicker part situated between the side members 60 and 61 and a thinner part situated between the extensions 54 and 55.

A slot 62 is cut into the side member 60 as far as the edge of the bar 51 adjacent the side member 61.

The bar 51 is bent along its axis (see FIGS. 9 and 10) until it is substantially on the longitudinal axis of the body 50 between the side members 60 and 61 and against the center member 53.

Two tangs 56 and 57 are cut out from the center member 53. They are bent so that they are perpendicular to the center member and cut to feature slots 58, the tangs constituting insulation displacement connecting means.

Of course, the invention is not limited to the embodiments described and shown. Numerous modifications of detail may be made thereto without departing from the scope of the invention.

There is claimed:

1. Male electrical contact comprising a substantially U-shape body incorporating two side members, a center member, a bar at one end and means at the opposite end for connecting said body to an electrical conductor, wherein said contact is manufactured by bending a blank formed from a material that is a good electrical conductor and that comprises two strips of different thickness and said bar and an adjoining part of said body are formed from the thicker of said strips.

2. Contact according to claim 1 wherein said bar forms an extension of one side member of said body and is bent during manufacture towards the other side member and so that it lies in a median plane through said center member.

3. Contact according to claim 1 wherein said body incorporates a slot transverse to said bar and the part of said bar adjacent said slot is bent into contact with said center member.

4. Contact according to claim 1 wherein said material has a relatively thick central strip and two relatively thin lateral strips and said blank are cut out from said material in pairs in a head-to-tail arrangement.

5. Contact according to claim 1 wherein said connecting means are of the insulation displacement type and comprise lugs cut out from said body, bent during manufacture to extend between said side members of said body and comprising slots in their free edges.

6. Contact according to claim 1 wherein said connecting means are of the insulation displacement type and comprise two branches bent during manufacture to form in conjunction with said center member a U-shape portion, each branch is extended at each end by a lug and said lugs are bent during manufacture so that said lugs on one branch are aligned with the corresponding lugs on the other branch.

7. Contact according to claim 6 wherein the part of said body comprising said connecting means and adjacent the part thereof comprising said bar incorporates a stiffener in the form of a rib.

8. Contact according to claim 6 wherein said branches incorporate stamped stiffeners.

9. Contact according to claim 6 wherein the end of said body opposite that comprising said bar incorporates tangs for crimping an electrical conductor.

10. Contact according to claim 9 wherein the part of said body comprising said crimping tangs and adjacent the part thereof comprising said connecting means incorporates a stiffener in the form of a rib.

* * * * *